United States Patent [19]

Teramachi et al.

[11] Patent Number: 4,907,305

[45] Date of Patent: Mar. 13, 1990

[54] BUBBLING BATHTUB SYSTEM

[75] Inventors: Keiichi Teramachi; Harue Kawagoe; Naoki Kumon; Shinya Hirota; Hidehiko Kishie; Tsutomu Amaki; Harushige Tsusaka, all of Osaka, Japan

[73] Assignee: Matsushita Electric Works, Ltd., Osaka, Japan

[21] Appl. No.: 240,329

[22] Filed: Sep. 6, 1988

[30] Foreign Application Priority Data

Sep. 4, 1987 [JP] Japan ..... 62-136083
Sep. 4, 1987 [JP] Japan ..... 62-136084

[51] Int. Cl.[4] ..... A61H 33/02; E03C 1/02

[52] U.S. Cl. ..... 4/542; 4/541; 4/544; 4/492; 128/66; 137/171

[58] Field of Search ..... 4/541, 542, 543, 544, 4/492, 494; 261/DIG. 88, DIG. 22, 124; 239/428.5; 128/66; 137/171, 202, 206, 493; 138/30

[56] References Cited

U.S. PATENT DOCUMENTS

| | | | |
|---|---|---|---|
| 2,435,449 | 2/1948 | Kubacki et al. | 261/DIG. 22 |
| 2,579,203 | 12/1951 | Putney | 261/124 |
| 2,633,343 | 3/1953 | Aghnides | 261/DIG. 22 |
| 2,741,327 | 4/1956 | Hedrich et al. | 216/124 |
| 3,173,614 | 3/1965 | Aghnides | 239/428.5 |
| 3,319,266 | 5/1967 | Schneider et al. | 4/544 |
| 3,672,359 | 6/1972 | Krohn | 128/66 |
| 3,786,829 | 1/1974 | Nardo et al. | 137/202 |
| 3,833,013 | 9/1974 | Leonard | 137/171 |
| 3,952,765 | 4/1976 | Kimura | 137/171 |
| 4,085,170 | 4/1978 | Simpson et al. | 261/124 |
| 4,104,004 | 8/1978 | Graef | 137/202 X |
| 4,119,686 | 10/1978 | Conger, IV | 261/124 |
| 4,193,417 | 3/1980 | Bowman et al. | 137/206 |
| 4,269,797 | 5/1981 | Mikiya et al. | 4/543 |
| 4,293,506 | 10/1981 | Lipert | 261/123 |
| 4,320,541 | 3/1982 | Neenan | 4/542 |
| 4,409,693 | 10/1983 | Baumann | 4/543 |
| 4,541,780 | 9/1985 | Moreland | 4/542 |
| 4,625,715 | 12/1986 | Bucher | 4/543 |
| 4,731,887 | 3/1988 | Henkin et al. | 4/542 |
| 4,733,818 | 3/1988 | Aqunides | 239/428.5 |
| 4,773,104 | 9/1988 | Wong | 4/492 |
| 4,797,958 | 1/1989 | Guzzini | 4/542 |
| 4,805,664 | 2/1989 | Matler et al. | 4/542 |

FOREIGN PATENT DOCUMENTS

| | | | |
|---|---|---|---|
| 2854788 | 7/1980 | Fed. Rep. of Germany | 4/542 |
| 3435453 | 4/1986 | Fed. Rep. of Germany | 4/492 |
| 3447161 | 7/1986 | Fed. Rep. of Germany | 4/492 |
| 2464687 | 4/1981 | France | 4/542 |
| 0022938 | 6/1985 | Japan | 128/66 |

*Primary Examiner*—Henry K. Artis
*Attorney, Agent, or Firm*—Sughrue, Mion, Zinn, MacPeak & Seas

[57] ABSTRACT

A bubbling bathtub system including both a large bubble generator, which blows relatively large bubbles into a bathtub, and a minute bubble generator, which functions so that bath water with air dissolved therein by pressurization is sent to the bathtub to produce minute bubbles in the bath water, connected to the bathtub. The relatively large bubbles produced by the large bubble generator and the minute bubbles produced by the minute bubble generator cooperate to enhance the good feeling produced during bathing. Both or either of the relatively large bubbles and the minute bubbles can be optionally produced as the user desires for optimum effect.

11 Claims, 11 Drawing Sheets

BUBBLING BATHTUB SYSTEM

BACKGROUND OF THE INVENTION

The present invention relates to a bubbling bathtub system employing the action of bubbles to create a pleasant sensation for the bather.

In a conventional bubbling bathtub system, bath water mixed with air is blown into a bathtub by a pump so that bubbles are forced into the bathtub water. In another conventional bubbling bathtub system, air alone is blown into the bathtub by a pump. In either case, the comfort of the bather is enhanced by the action of the bubbles.

In order to regulate the action of the bubbles, the discharge rate of the pump is controlled so that the intensity of the action of the bubbles is changed. As a result, only the massaging strength of the bubbles on the bather can be adjusted. For that reason, it has been desired to make the sensations produced during bathing more comfortable.

SUMMARY OF THE INVENTION

The present invention was made in order to meet the above-mentioned requirement.

Accordingly, it is an object of the present invention to provide a bubbling bathtub system which enhances the good feeling produced during bathing.

In the inventive bubbling bathtub system, both a large bubble generator, which blows relatively large bubbles into a bathtub, and a minute bubble generator, which functions so that bath water with air dissolved therein by pressurization is sent to the bathtub to produce minute bubbles in the bath water, are connected to the bathtub. The relatively large bubbles produced by the large bubble generator and the minute bubbles produced by the minute bubble generator cooperate to enhance the good feeling produced during bathing. Both or either of the relatively large bubbles and the minute bubbles can be optionally produced as the user desires for optimum effect.

The minute bubble generator may be provided with an accumulator which discharges excess air not dissolved in the bath water and promotes the dissolution of air in the bath water to more effectively produce the minute bubbles.

It is preferable that the bubble generator and the minute bubble generator jointly use a single pump as a drive to shorten the length of piping and to simplify the bubbling bathtub system. In the case of the joint use of the pump, a minute bubble nozzle unit for blowing the minute bubbles into the bathtub and a water inlet port for taking in bath water from the bathtub are connected to each other through a pipe outside the bathtub. The pump, an air intake device, and the accumulator are provided in the pipe. A ramified passage is connected to the pipe through a changeover valve coupled between the accumulator and the minute bubble nozzle unit and connected to the jet nozzle unit of the bubble generator. An shut-off valve for opening or closing the air inlet port of the air intake device is provided with which the air inlet port is closed in conjunction with the switching of the changeover valve toward the jet nozzle unit, the air inlet port of the air intake device is closed by the shut-off valve so that bath water not mixed with bubbles is sent to the pump to prevent the power of the pump from falling due to the mixing of bubbles. The bath water can thus be well pressurized by the pump.

The accumulator may be composed of a large-diameter portion provided as a part of the pipe of the minute bubble generator and downwardly inclined downstream, a riser connected to the large-diameter portion near the downstream end thereof, and an air release portion provided at the top of the riser. When the excess air is separated from the bath water by the accumulator, a component of the buoyancy of the excess air acts in the direction reverse to that of the flow of the bath water so that the flow speed of the excess air is made lower than that of the bath water to expedite the separation of the excess air from the bath water. The excess air is thus separated from the bath water smoothly through a simple construction to enhance the air and water separation performance of the accumulator. As a result, not only is the discharge of the excess air stabilized, but also the production costs of the accumulator are reduced and maintenance of the accumulator is eliminated. Moreover, the bath water cannot stagnate in the accumulator, the valve of the air release portion and the minute bubble nozzle unit cannot be jammed or clogged with contaminants, and the accumulator is unlikely to be damaged due to freezing.

For example, the air release portion can be constituted so that a vertical pipe is attached to the air accumulating portion of the accumulator, a needle is fitted in the vertical pipe movable up and down, a prescribed clearance for discharging gas from the accumulator is defined between the needle and the vertical pipe, an upper plate is provided on the top of the needle and movable into and out of contact with the edge of the vertical pipe at the upper open end thereof, and the needle is urged downward by the force of a spring. Because of the prescribed clearance between the needle and the vertical pipe, the gas is smoothly discharged from the accumulator. The interior of the vertical pipe is cleaned by the vertical movement of the needle to make it unlikely that the vertical pipe will be clogged with extraneous substances or the needle will seize on the pipe due to such substances. During the running of the bubbling bathtub system, the needle is slightly vibrated due to the force of the spring to clean the interior of the vertical pipe. At the beginning and end of the running of the system, the needle is moved up and down to prevent clogging and seizure, thereby eliminating the need for maintenance of the air release portion.

For example, the minute bubble nozzle unit of the minute bubble generator can be constituted so that a pressure reduction plate having a plurality of through-holes is provided downstream to the portion of the nozzle unit into which the bath water with air dissolved therein is introduced. The pressure reduction plate acts so that the pressure of the bath water with the air dissolved therein is reduced as the water is sent into the bathtub.

It is preferable that a plurality of meshes be juxtaposed together downstream of the pressure reduction plate. It is also preferable that the meshes be provided as an assembly. Due to the presence of the pressure reduction plate, the bath water is dispersed through the holes in the plate, thus preventing the dispersed streams of bath water from interfering with each other. For that reason, the pressure of the bath water is slowly reduced, and bubbles are less likely to congregate to form larger bubbles. As a result, minute bubbles are efficiently produced. If a plurality of meshes are juxtaposed together downstream of the pressure reduction plate, the bath water collides against the meshes immediately after being dispersed through the holes of the plate, so that the pressure of the bath water is moderately reduced and bubble nuclei are formed to promote the production of the minute bubbles. If the plurality of meshes are provided as an assembly, the production of the minute bubbles is more efficiently promoted.

The minute bubble nozzle unit may be composed of a bath water intake portion, which extends through the side wall of the bathtub and is secured with seals to the side wall to keep the bath water from leaking and which is provided with an opening through which the pressurized bath water is introduced into the nozzle unit, and a minute bubble generating portion, which is removable attached to the bath water intake portion from the interior of the bathtub. The pressure reduction plate and the meshes are removably attached to the minute bubble generating portion so that the plate is disposed in mesh holder and the meshes are pushed and retained by the holder to maintain a prescribed distance between the plate and meshes. After the minute bubble generating portion and the mesh holder are sequentially detached, the meshes can be easily removed and washed or replaced. The holes of the pressure reduction plate can be also easily cleaned.

The jet nozzle unit of the bubble generator may be provided with a plurality of water feed ports or/and a plurality of air feed ports. If the jet nozzle unit is provided with a plurality of air feed ports, jet nozzle units neighboring each other can be connected to each other by a shorter pipe to feed the bath water from one of the jet nozzle units to the other through the water feed ports. For that reason, ramified pipes need not be provided for the jet nozzle units. As a result, the resistance to the passage of the bath water is reduced, and the number of piping members is decreased to reduce the cost of the piping. If the jet nozzle unit is provided with a plurality of air feed ports, the total air passage length is shortened.

DESCRIPTION OF THE PREFERRED EMBODIMENTS

Preferred embodiments of the present invention are hereafter described in detail with reference to the attached drawings.

Figure 1:
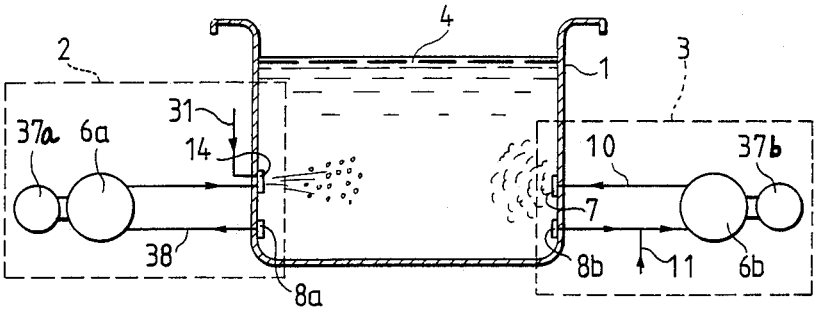
FIG. 1 shows a partially sectional view of a bubbling bathtub system constructed according to a first preferred embodiment of the present invention.

FIG. 1 shows a bubbling bathtub system of a first embodiment having a bathtub 1 connected to a large bubble generator 2 at the left-hand side of the bathtub and a minute bubble generator 3 at the right-hand side of the bathtub in the drawing.

The large bubble generator 2 includes a water inlet port **8*a* and a jet nozzle unit 14 which are attached to the side wall of the bathtub 1, a pipe 38 for connecting the water inlet port and the jet nozzle unit to each other, and a jet pump 6*a* provided with a motor 37*a* for driving the pump. The jet pump 6*a* is disposed midway of the pipe 38 of the large bubble generator 2. The jet nozzle unit 14 is provided with an air pipe 31 having an air inlet port. Bath water is sent from the water inlet port 8*a* to the bathtub 1 through the pipe 38 by the pump 6*a* so that the bath water is spouted into the bathtub through the jet nozzle unit 14. Simultaneously, air is sucked into the jet nozzle unit 14 from the air pipe 31 so that the air is mixed as bubbles in the bath water 4 being spouted into the bathtub 1. Bubbles are thus produced in the bathtub 1**. The diameter of the bubbles range from about 1 to 30 mm.

After the bubbles are released in the bathtub 1, the bubbles ascend to the surface of the bath water 4 and disappear. The bubbles produced in the bathtub 1 by the large bubble generator 2 on the bather together with the spouted bath water 4 produce a massaging effect. Due to this streaming in the bath water 4, the bather senses an effective temperature of about 1° to 3° C. higher than when the bath water is still. Thus, the body temperature of the bather is less likely to drop quickly to cause a chill after the bath.

The minute bubble generator 3 includes a water inlet port **8*b* and a minute bubble nozzle unit 7, which are attached to another side wall of the bathtub 1, and further a pipe 10 for connecting the water inlet port and the minute bubble unit to each other, and a pressure pump 6*b* for producing minute bubbles in the bathtub 1. The pressure pump 6*b* is provided with a motor 37*b* for driving the pump disposed in the middle portion of the pipe 10. An air suction device 11 having an air inlet port is connected to the pipe 10 between the water inlet port 8*b* and the pump 6*b*. When bath water 4 is sucked into the pipe 10 through the water inlet port 8*b* by the pump 6*b* and flows through the pipe, air is also sucked into the pipe from the air suction device 11 so that the bath water is mixed with the air and pressurized by a pressure of about 5 kg/cm$^2$ in the pump 6*b*. Because of this pressurization, the air is dissolved in the bath water 4. The bath water 4 with the air dissolved therein is sent to the minute bubble nozzle unit 7 through the pipe 10 while the bath water remains pressurized, so that the water is introduced into the bathtub 1** through the minute bubble nozzle unit.

The minute bubble nozzle unit 7 has a plurality of nozzles each having a diameter of about 1 mm, for example. When the bath water 4 with the air dissolved therein is introduced into the bathtub 1 through the minute bubble nozzle unit 7, the bath water is immediately depressurized so that the air dissolved therein is educed and forms minute bubbles in the bath water in the bathtub. Since the diameter of each of the minute bubbles is as small as about 5 to 30 μm, the speed of ascent thereof in the bath water 4 is so low that the minute bubbles do not immediately rise to the surface of the bath water in the bathtub 1 but stay in the water for about two minutes to whiten the otherwise colorless and transparent bath water. If the minute bubble generator 3 is kept out of action for several minutes, the minute bubbles disappear so that the whitened bath water 4 becomes colorless and transparent again. The minute bubbles in the bath water 4 in the bathtub 1 wrap the bathing person so that he or she perceives a temperature about 1° to 3° C. higher than when the minute bubbles are not produced in the bathtub. For this reason, the blood pressure of the bathing person is prevented from sharply rising upon entering the bath water 4, and the body temperature is less likely to fall quickly after getting out of the bathtub. Also, a pleasant visual effect is produced by the whitening of the bath water 4.

The bubble generator 2 and/or the minute bubble generator 3 can be optionally used to produce bubbles as desired to create a particular bathing sensation in the bathtub 1. For example, when the bather begins bathing in the bathtub 1, the bubble generator 2 can be turned off but the minute bubble generator 3 activated to produce minute bubbles to acclimate the body of the bather to the temperature of the bath water to prevent his or her blood pressure from sharply rising. Afterward, the minute bubble generator 3 can be turned off and the bubble generator 2 activated to massage the bather's body with rapid streams of bath water 4 and relatively large bubbles. The bather is thus made more comfortable. Both the bubble generator 2 and the minute bubble generator 3 can be simultaneously operated to subject the body of the bather to relatively large bubbles and minute bubbles.

Figure 2:
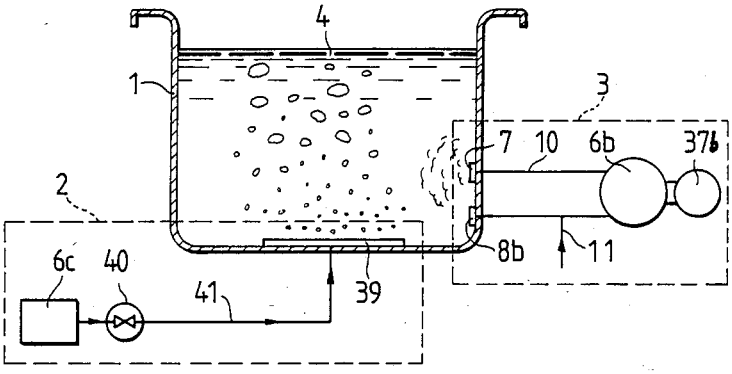
FIG. 2 shows a partially sectional view of a bubbling bathtub system of a second embodiment of the present invention.

FIG. 2 shows a bubbling bathtub system of a second embodiment. Although the minute bubble generator 3 of the bubbling bathtub system is the same as that of the bubbling bathtub system shown in FIG. 1, the bubble generator 2 of the system shown in FIG. 2 includes a porous plate 39 and an air pump **6*c*. The porous plate 39 is provided on the bottom of the bathtub 1 of the system. The pump 6*c* is connected to the porous plate 39 through a pipe 41 provided with a check valve 40. Air is sent from the pump 6*c* to the porous plate 39 through the pipe 41 so that the air is divided into small segments by the porous plate, forming bubbles when the air is blown into the bath water 4. The blowoff of the air from the bottom of the bathtub 1 and the buoyancy of the bubbles produce the same effects as the bubble generator 2 of the system shown in FIG. 1**.

Figure 3:
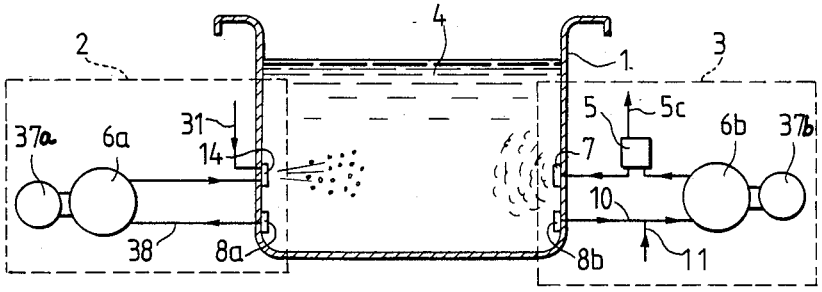
FIG. 3 shows a partially sectional view of a bubbling bathtub system of a third embodiment of the present invention.
Figure 4:
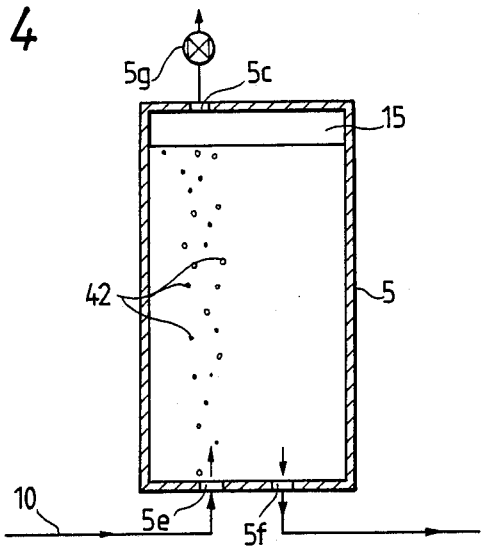
FIG. 4 shows a sectional view of the accumulator of the bubbling bathtub system shown in FIG. 3.

FIG. 3 shows a bubbling bathtub system of a third embodiment. Although the bubble generator 2 of the bubbling bathtub system is the same as that of the system shown in FIG. 1, the minute bubble generator 3 of the system shown in FIG. 3 includes an accumulator 5 formed by a hermetically sealed container. The accumulator 5 is provided between a pump **6*b* and a minute bubble nozzle unit 7 and is connected to a pipe 10. As shown in FIG. 4, an inlet port 5*e* and an outlet port 5*f* are provided in the bottom of the accumulator 5 and are connected to the pipe 10. The accumulator 5 has an air release portion including a flow control valve 5*g* at an air release port 5*c* provided in the top of the accumulator. Bath water 4 is pressurized by the pump 6*b* so that air is dissolved in the bath water. After the bath water 4 with the air dissolved therein is introduced into the accumulator and temporarily held therein, the water is sent to the bathtub 1 of the system through a minute bubble nozzle unit 7. The accumulator 5 not only performs absorption of the pulsation of the bath water 4, absorption of impulsive pressure therein, and the like, but also functions so that the dissolution of air not dissolved in the bath water by the pressurization thereof in the pump 6*b* is promoted and excess air 42 remaining not dissolved in the bath water is allowed to ascend to the upper air accumulating portion 15 of the accumulator and separate from the bath water. The excess air is then released into the atmosphere through the air release portion of the accumulator 5. Since the accumulator 5 thus acts to increase the concentration of the air dissolved in the bath water 4 and release the excess air 42 from the bath water, only minute bubbles are efficiently produced in the bath water through the minute bubble nozzle unit 7**.

Figure 5:
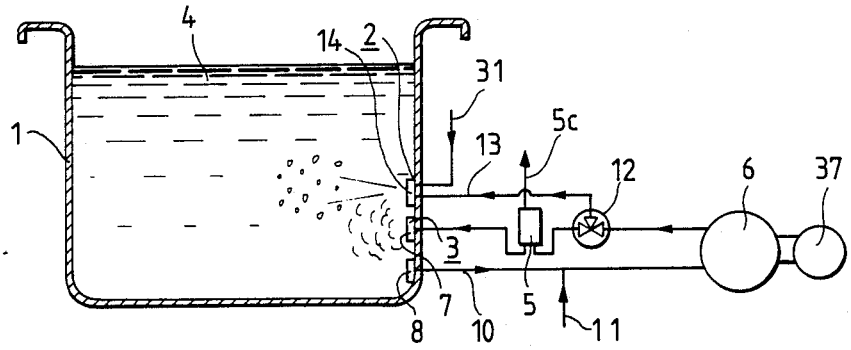
FIG. 5 shows a partially sectional view of a bubbling bathtub system of a fourth embodiment of the present invention.

FIG. 5 shows a bubbling bathtub system of a fourth embodiment. In this system, a pump 6, which is driven by a motor 37, is used for both a bubble generator 2 and a minute bubble generator 3 so that the weight, size and cost of the system are decreased. A water inlet port 8, a jet nozzle unit 14 and a minute bubble nozzle unit 7 are provided at the side wall of the bathtub 1 of the system. The pump 6 is provided in a pipe 10 of the minute bubble generator 3 which connects the water inlet port 8 and the minute bubble nozzle unit 7 to each other. A pipe 13 is ramified from the pipe 10 between the pump 6 and the minute bubble nozzle unit 7 and is provided with a three-way change-over valve 12, namely, a solenoid valve. The upstream end of the pipe 13 is connected to the jet nozzle unit 14. An air suction device 11 including an air inlet port is connected to the pipe 10 between the water inlet port 8 and the pump 6. An accumulator 5 is connected to the pipe 10 between the three-way changeover valve 12 and the minute bubble nozzle unit 7. An air pipe 31 is connected to the jet nozzle unit 14. When bath water 4 is sucked into the pipe 10 through the water inlet port 8 by the pump 6 and flows through the pipe, air is sucked into the bath water through the air suction device 11 so that the air is dissolved in the water by pressurization in the pump 6. When the pump 6 and the minute bubble nozzle unit 7 are connected to each other through the three-way changeover valve 12, bath water 4 with air dissolved therein is sent from the pump 6 to the minute bubble nozzle unit 7 through the pipe 10 and introduced into the bathtub 1 through the minute bubble nozzle unit so that minute bubbles are produced in the bath water in the bathtub. When the pump 6 and the jet nozzle unit 14 are connected to each other through the three-way changeover valve 12, the bath water 4 is sent from the pump to the jet nozzle unit through the pipe 13 so that air is sucked into the bath water through the air pipe 31. Thus, the air forms relatively large bubbles in the bath water. The mixture of the water and the bubbles is spouted into the bathtub 1 through the jet nozzle unit. The minute bubbles or the relatively large bubbles can thus be optionally produced in the bath water 4 in the bathtub 1 merely by switching the three-way changeover valve 12. Since the jet nozzle unit 14 and the minute bubble nozzle unit 7 are provided independently of each other, they can be attached in optional positions to optimally project rapid streams of the bath water 4 from the jet nozzle unit to the bather and most efficiently spread the minute bubbles from the minute bubble nozzle unit into the bathtub.

Figure 6:
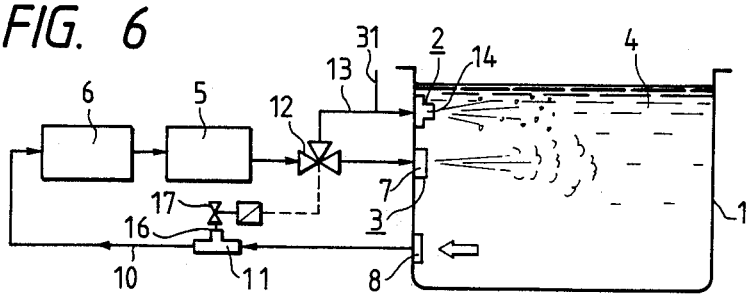
FIG. 6 shows a partially sectional view of a bubbling bathtub system of a fifth embodiment of the present invention.

FIG. 6 shows a bubbling bathtub system of a fifth embodiment. Although the basic piping of the system is the same as that of the system shown in FIG. 5, the system shown in FIG. 6 includes a shut-off valve 17 for opening or closing the air inlet port 16 of an air suction device 11. The air inlet port 16 is closed by the shut-off valve 17 in conjunction with the switching of a three-way changeover valve 12 toward a jet nozzle unit 14, or opened by the shut-off valve in conjunction with the switching of the three-way changeover valve toward the minute bubble nozzle unit 7. When the three-way changeover valve 12 is switched toward the jet nozzle unit 14, the air inlet port 16 is closed by the shut-off valve 17 so that no air is sucked into the bath water 4 through the air suction device 11. As a result, bath water having no bubbles mixed therein is sent to a pump 6. The power of the pump is prevented from falling due to the mixing of bubbles in the water. Therefore, the bath water 4 is pressurized by the pump 6 so well that the bath water is strongly and rapidly spouted into the bathtub 1 of the system as air is sucked in through the jet nozzle unit 14 and mixed as bubbles into the bath water.

Figure 7:
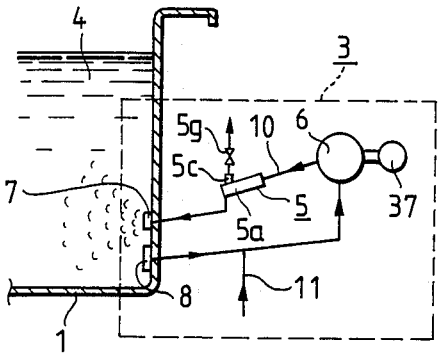
FIG. 7 shows a partially sectional view of a bubbling bathtub system of a sixth embodiment of the present invention.

FIG. 7 shows a bubbling bathtub system of a sixth embodiment. In this system, the pipe 10 of a minute bubble generator 3 has a cylindrical large-diameter portion **5*a* whose diameter is larger than that of the other portion of the pipe. The large-diameter portion 5*a* is downwardly inclined downstream. A riser 5*b* (FIGS. 8 and 9) extends upwards from the upper side of the large-diameter portion 5*a* near the downstream end thereof. The upper portion of the riser 5*b* functions as an air release portion 5*c*. The large diameter portion 5*a*, the riser 5*b* and the air release portion 5*c* constitute the accumulator 5** of the system.

Figure 8:
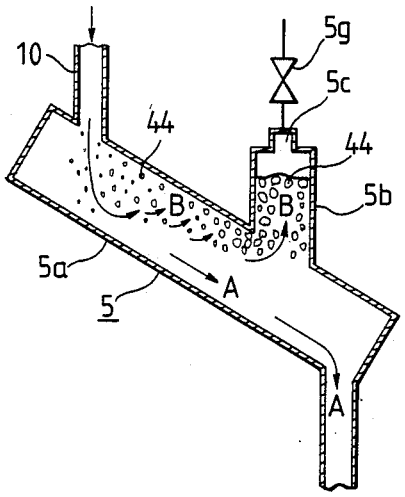
FIG. 8 shows a sectional view of the accumulator of the bubbling bath system shown in FIG. 7.
Figure 9:
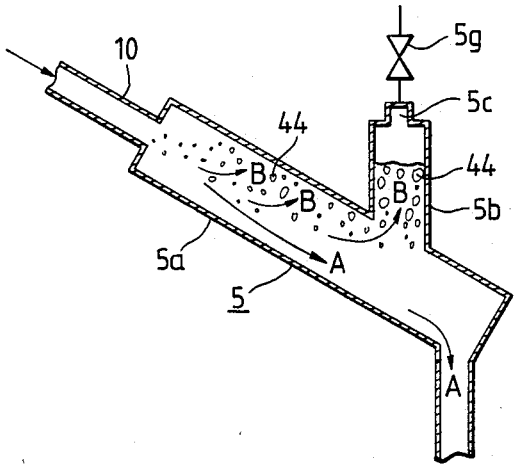
FIG. 9 shows a sectional view of an accumulator which is a modification of the accumulator shown in FIG. 8.
Figure 10:
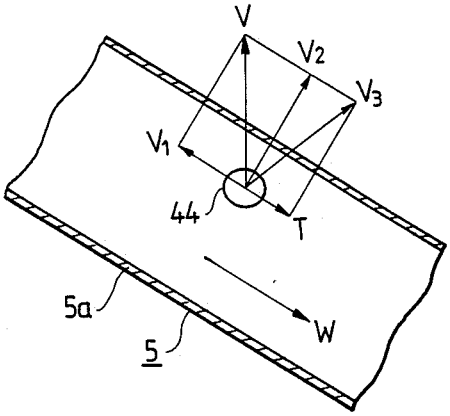
FIG. 10 is a view for describing the operation of the accumulators shown in FIGS. 8 and 9.

The pipe 10 for connecting a pump 6 and a minute bubble nozzle unit 7 to each other is downwardly inclined downstream from the pump toward the minute bubble nozzle unit. Although the pipe 10 is connected to the upper side of the large diameter portion **5*a* as shown in FIG. 8, the pipe may be connected to the upstream end of the large-diameter portion as shown in FIG. 9. When the pump 6 is driven, bath water is sucked in from the bathtub 1 of the system through a water inlet port 8 and flows through the pipe 10. Simultaneously, air is sucked into the pipe 10 through the air suction device 11 so that the bath water is mixed with the air and pressurized in the pump 6 and the air is dissolved in the water by pressurization. The bath water with the air dissolved therein is sent to the minute bubble nozzle unit 7 through the pipe 10 while the water remains pressurized. When the bath water flows through the large-diameter portion 5*a* of the accumulator 5, the accumulator not only absorbs pulsation of the bath water, impulsive pressure, and the like, but also functions to promote dissolution of air not dissolved in the bath water by the pressurization thereof in the pump and to allow excess air not dissolved in the bath water to ascend to the riser 5*b* and separate from the water. In other words, when the bath water containing air flows through the large-diameter portion 5*a* of the accumulator 5, as shown by an arrow A in FIG. 8 or 9, the speed of the flow of the bath water falls in the large-diameter portion so that the air is more likely to move upward in the large-diameter portion due to buoyancy. For that reason, dissolution of the air in the bath water is promoted and the excess air is separated from the water. Since the large-diameter portion 5*a* is downwardly inclined downstream, the buoyancy-based speed V of each bubble 44 has a component $V_1$ reverse in direction to the flow speed W of the bath water, as shown in FIG. 10, so that the bubble has a speed component T which is in the same direction as the flow speed of the bath water. T can be expressed as $T=W-V_1$. Thus, the flow speed of the bubbles 44 in the large-diameter portion 5*a* is lower than that W of the bath water therein and the bubbles flow in the direction of a speed component $V_3$. Hence, the separation of the bubbles from the bath water is promoted. In FIG. 10, $V_2$ means a speed component which is perpendicular to the pipe wall. The air thus separated from the bath water, as shown by an arrow B in FIG. 8 or 9, is accumulated in the riser 5*b* and released through the air release portion 5*c*. If the riser 5*b* were not located in a position where undissolved air is not sufficiently moved to the upper side of the large-diameter portion 5*a*, some of the air would not be separated from the bath water. For that reason, the riser 5*b* is located near the downstream end of the large-diameter portion 5*a*. The bath water containing the dissolved air and passed through the large-diameter portion 5*a* is sent to the bathtub 1 through the minute bubble nozzle unit 7**.

In the embodiments shown in FIGS. 8 and 9, the flow speed of the bath water mixed with air falls when the water passes through the large-diameter portion 5a as mentioned above, so that the air in the bath water is more likely to move upward in the accumulator due to the buoyancy of the air. For that reason, the dissolution of the excess air in the bath water is promoted, and excess air not dissolved in the water even by such promotion is separated therefrom, accumulated in the riser 5b, and released through the air release portion 5c. Since the large-diameter portion 5a is downwardly inclined downstream, the component of the buoyancy of the air acts in the direction reverse to that of the flow of the bath water so that the flow speed of the air is made lower than that of the bath water to promote the separation of the excess air from the water.

When the pump 6 is deactivated and the bath water is drained from the bathtub 1, the remaining bath water in the large-diameter portion 5a of the accumulator 5 gravitates downstream so that all the remaining bath water flows out of the large-diameter portion.

Figure 11:
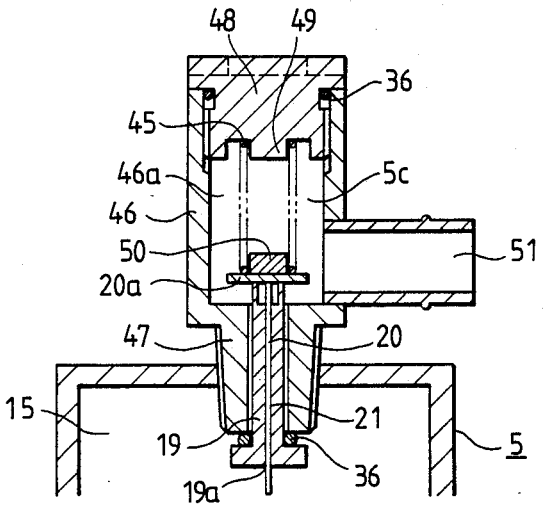
FIG. 11 shows a sectional view of an air release portion constructed according to the present invention and provided in an accumulator.
Figure 12:
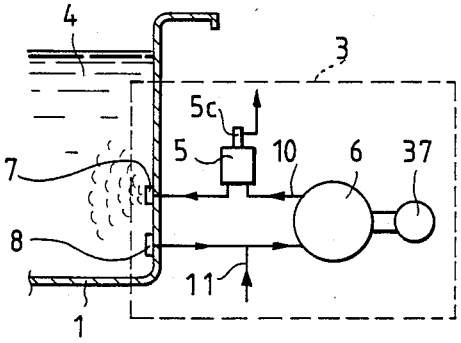
FIG. 12 is a partially sectional view for describing an example of use of the air release portion shown in FIG. 11.

FIGS. 11 and 12 show an air release portion 5c provided in an accumulator constructed according to another embodiment of the present invention. The air release portion 5c, which is disposed at the top of the accumulator 5, is composed of a vertical pipe 19, a needle 20 movably fitted therein, and a spring 45 for pushing the needle downward. The vertical pipe 19 is secured to the lower cylindrical attaching portion 47 of a casing 46 and vertically extends through the portion 47 secured in the body of the accumulator 5. The cross section of the inside circumferential surface of the vertical pipe 19 is circularly shaped. A prescribed clearance for releasing air from the accumulator 5 is defined between the inside circumferential surface of the vertical pipe 19 and the needle 20 fitted therein and movable up and down. The upper portion of the needle 20 is secured to the center of an upper plate 20a which can be moved into and out of contact with the edge of the vertical pipe 19 at the open upper end thereof. The lower portion of a plug 48 is screwed in the upper portion of the casing 46. The spring 45 is interposed between the projection 49 of the bottom of the plug 48 and the projection 50 of the central portion of the top of the upper plate 20a and urges the needle 20 downward. The wall of the casing 46 has an air release port 51 communicating with an air release chamber 46a in the casing. Shown at 36 in FIG. 11 is an O-ring for hermetic sealing.

The diameter of the needle 20 is as small as about 0.5 mm. The inside diameter of the vertical pipe 19 is determined in terms of various conditions. If the inside diameter of the vertical pipe 19 is about 0.75 mm, for example, the clearance 21 between the pipe and the needle 20 is about 0.125 mm, which is large enough to greatly reduce the possibility of jamming or seizure of the needle in the pipe. The length of the needle is made large enough to prevent it from coming off the vertical pipe 19 when the needle is pushed up to the upper portion of the casing 46. A compressed helical spring can be used as the spring 45 to counter the force which pushed up the needle 20. If the stiffness of the spring 45 is too high, the spring will be hardly compressed and therefore cannot act to release the excess pressure of air. If the stiffness of the spring is too low, the spring 45 will be completely compressed, even when the compression force is weak, so that the needle 20 remains pushed up and therefore cannot be slid up and down to release the excess pressure of air. For these reasons, the stiffness of the spring 45 should be determined in consideration of the pressure in the accumulator 5, the quantity of the released air, the range of fluctuation in the pressure, etc. When the pump 6 is driven to blow minute bubbles into a bathtub 1 through a minute bubble nozzle unit 7, excess air separated from bath water 4 in the accumulator 5 is discharged through the air release portion 5c. At that time, pressurization remains in the accumulator 5, and the air accumulated in the upper part of the body of the accumulator flows into the air release chamber 46a in the casing 46 through the inlet port 19a in the lower end of the vertical pipe 19 and the clearance 21 between the pipe and the needle 20 and is then discharged through the air release port 51. Although only a very small quantity of the bath water 4 sometimes mixes with the discharged air, the quantity is not larger than one-twentieth to one-tenth of that from a conventional needle valve and is therefore greatly reduced in comparison therewith.

The operation of the air release portion 5c shown in FIGS. 11 and 12 will now be described in detail. When the minute bubble generator 3 of the bubbling bathtub system is deactivated, the needle 20 is in a downward position due to gravity and the force of the spring 45, and the upper plate 20a is in contact with the edge of the vertical pipe 19 at the open upper end thereof. When the minute bubble generator 3 is thereafter activated so that the excess air is separated from the bath water 4 in the accumulator 5 and is pressurized, the air rapidly passes upward through the inlet port 19a of the lower end of the vertical pipe 19 and the clearance 21 between the pipe and the needle 20 so that the needle is pushed up and the air is discharged through the air release portion 5c. At that time, the needle 20 is slid on the inside circumferential surface of the vertical pipe 19 so that seizure of the needle to the pipe, accumulation dust, and the like is prevented. While the minute bubble generator 3 is in action, the needle is vibrated up and down due to small pressure fluctuations, oscillation, a pressure increase at the time of discharge of bath water, and the compressive force of the spring 45 provided over the needle, so that the needle is slid relative to the vertical pipe 19 to prevent seizure of the needle to the pipe, clogging of the pipe with dust, and the like. In order to slide the needle 20 properly, it is required that the force which pushes up the needle by the pressure and flow in the accumulator 5, the force of the spring 45, which urges the needle downward, and the self-restoring force of the spring be suitably chosen relative to one another. When the minute bubble generator 3 is deactivated, the needle 20 is moved down by gravity and the self-restoring force of the spring 45. At that time, seizure of the needle 20 to the vertical pipe 19, clinging of dust, and the like are prevented as well. In other words, the needle 20 is strongly moved up and down, respectively, at the beginning and end of the running of the minute bubble generator 3 to prevent seizure of the needle to the vertical pipe 19, and is slightly vibrated due to the pressure fluctuations and the self-restoring force of the spring 45 during the running of the generator to further prevent the seizure of the needle to the pipe, etc.

Figure 13:
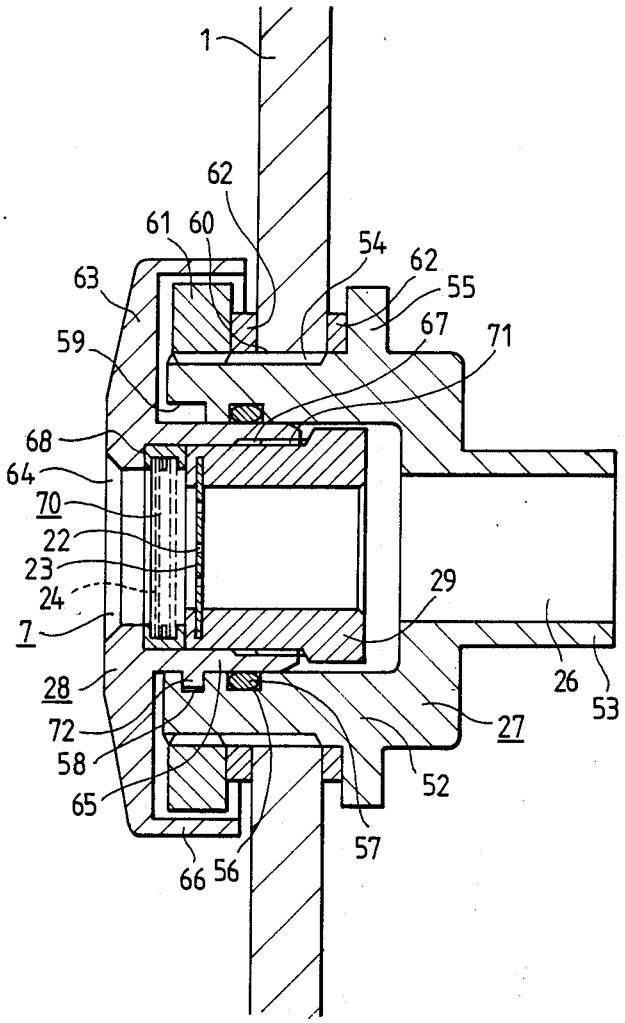
FIG. 13 shows a sectional view of a minute bubble nozzle unit constructed according to the present invention.
Figure 14:
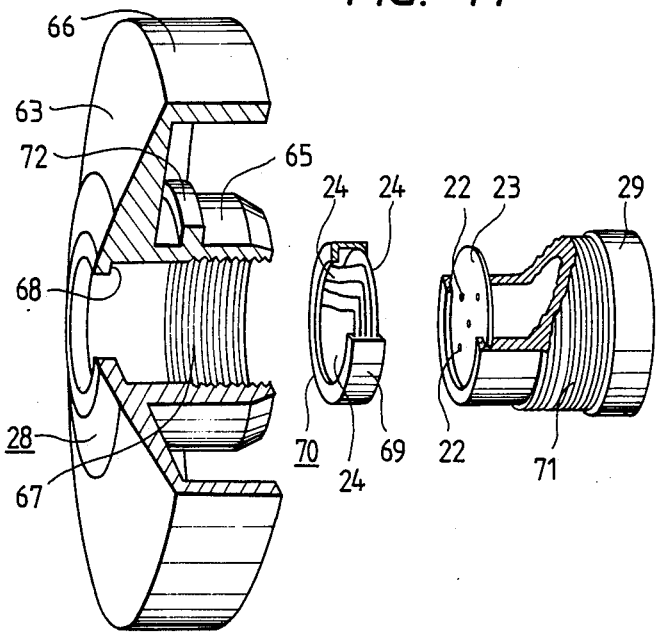
FIG. 14 shows an exploded cutaway view of the minute bubble nozzle unit shown in FIG. 13.

FIGS. 13, 14, 15 and 16 show a minute bubble nozzle unit 7 which is provided in a minute bubble generator 3 and is constructed according to an embodiment of the present invention. The minute bubble nozzle unit 7 has a bath water intake portion 27 and a minute bubble outlet fixture 28 as shown in FIG. 13. The bath water intake portion 27 includes a cylindrical body 52 and a coupling cylinder 53 provided at the rear of the cylindrical body and smaller in diameter than the body. The rear end of the coupling cylinder 53 has an opening 26 through which pressurized bath water 4 mixed with bubbles is introduced into the bathtub 1. A male screw 54 is provided on the outside circumferential surface of the front part of the cylindrical body 52. A flange 55 is provided on the outside circumferential surface of the cylindrical body 52 behind the male screw 54. An inside circumferential groove 56 is provided in the inside circumferential surface of the cylindrical body 52. An O-ring 57 is fitted in the groove 56. An engaging groove 58 is provided in the inside circumferential surface of the cylindrical body 52 in front of the inside circumferential groove 56. Notches 59 are provided in the cylindrical body 52 extending from the front end of the body to the engaging groove 58. The cylindrical body 52 is inserted from the outside into a hole 60 provided in the side wall of the bathtub 1. Seals 62 are fitted on the side wall of the bathtub 1. A nut 61 is engaged on the male screw 54 of the cylindrical body 52 inside the bathtub 1 so that the body is attached to the bathtub. The minute bubble generating portion 28 includes a front plate 63, an inner cylinder 65 which extends backward therefrom and whose internal opening communicates with the center hole 64 of the front plate, and an outer cylinder 66 extending backward from the peripheral portion of the front plate and which is smaller in length than the inner cylinder. A female screw 67 is provided on the rear part of the inside circumferential surface of the inner cylinder 65. The minute bubble generating portion 28 has a lip 68 at the front end of the inside circumferential surface of the inner cylinder 65. A mesh assembly 70 having a plurality of meshes 24 retained by a peripheral frame 69 is fitted in the inner cylinder 65. A cylindrical mesh holder 29 is inserted into the inner cylinder 65. A male screw 71 provided on the outside circumferential surface of the mesh holder 29 is engaged with the female screw 67 so that the mesh assembly 70 is pressed against the lip 58 and thus attached to the minute bubble generating portion 28. A pressure reduction plate 23 having a plurality of holes 22 is attached in a prescribed position to the mesh holder 29 beforehand so that a prescribed distance is defined between the pressure reduction plate 23 and the meshes 24 when the mesh holder 29 is pressed against the mesh assembly 70 so as to fix the mesh assembly 70 at a prescribed position within the minute bubble generating portion 28. projections 72, each having such a size as to be capable of being inserted into the notches 59, are provided on the outside of the inner cylinder 65. The inner cylinder 65 is inserted into the cylindrical body 52 of the bath water intake portion 27 from the interior of the bathtub 1 so that the engaging projections 72 are inserted into the engaging groove 58 from the notches 59. Then, the minute bubble outlet fixture 28 is turned so that the engaging projections 72 are fitted in the parts of the engaging groove 58 at which the notches 59 are not present. The minute bubble outlet fixture 28 is thus attached to the bath water intake portion 27 from the interior of the bathtub 1 after the bath water intake portion is attached to the bathtub. As a result, the O-ring 57 is held in pressure contact with the outside circumferential surface of the inner cylinder 65. Instead of providing the engaging groove 58, the notches 59 and the engaging projections 72 to attach the minute bubble outlet fixture 28 to the bath water intake portion 27, the outside circumferential surface of the inner cylinder 65 may be screwengaged with the inside circumferential surface of the cylindrical body 52 to attach the outlet fixture 28 to the other portion 27 so that they can be optionally and easily detached from each other. If the minute bubble outlet fixture 28 attached to the bath water intake portion 27 is to be detached therefrom, the portion 28 is turned back to place the engaging projections 72 at the notches 59 and is then pulled out of the portion 27. After the minute bubble generating outlet fixture 28 is detached from the bath water intake portion 27, the mesh holder 29 can be removed from the inner cylinder 65 to detach the mesh assembly 70 and clean it.

The end of the pipe 10 of the minute bubble generator 3 is connected to the opening 26 of the bath water intake portion 27 of the minute bubble nozzle unit 7 (shown in FIGS. 13, 14, 15 an 16) and attached to the bathtub 1 as described above so that pressurized bath water 4 with air dissolved therein is sent into the opening 26 of the bath water intake portion. The pressure of the bath water 4 is reduced by the pressure reduction plate 23 as the water is dispersed through the holes 22 of the plate. Immediately after the bath water 4 is dispersed through the holes 22 of the plate 23, the water collides against the plurality of meshes 24 so that the pressure of the water is slowly reduced and bubble nuclei are formed to promote the production of minute bubbles. When the bath water 4 is introduced into the bathtub 1, the water is immediately depressurized so that the air dissolved in the water is educed and forms the minute bubbles therein in the bathtub.

The pressure reduction plate 23 may, for example, be made of stainless steel 1 mm in thickness. Bath water 4 with the air dissolved therein is dispersed by the plate 23 into streams, the number of which is equal to that of the holes 22 of the plate. The flow rate of the bath water 4 in each of the holes 22 is small. The pressure of the bath water 4 is slowly reduced by the plate 23. The educed air bubbles are less likely to congregate so that the bubbles remain minute. It is preferable that the distance between the mutually neighboring holes 22 of the pressure reduction plate 23 not be made too short but set at about 5 mm. The thickness of the plate 23 should be such as to enable it to withstand the pressure of the bath water 4, but otherwise is not particularly limited. The plate 23 may be made of a metal (such as stainless steel) or plastic.

In order to produce the minute bubbles in the bath water 4, it is required to reduce the pressure of the water slowly, prevent the bubbles from congregating and forming larger bubbles, and form bubble nuclei, as described above. In the embodiment shown in FIGS. 13, 14, 15 and 16, the mesh assembly 70 having the plurality of meshes 24 juxtaposed on each other is disposed in front of the pressure reduction plate 23 at the prescribed distance therefrom so as to make the diameter of each of the minute bubbles as small as possible.

The number of the meshes 24 of the assembly 70 has a defined relationship with the diameter of the minute bubbles. If the number of the meshes 24 is as small as one to three, the diameter of each minute bubble tends to increase. If the number of the meshes 24 is as large as 11 or more, the bath water 4 stagnates in the meshes to let the bubbles congregate and form larger bubbles. Therefore, the appropriate number of the meshes 24 of the assembly 70 is four to ten. The optimal number of the meshes 24 is determined in consideration of the diameter of the minute bubbles, the pressure of the bath water 4, the flow rate thereof, the void ratio thereof, etc.

Figure 18:
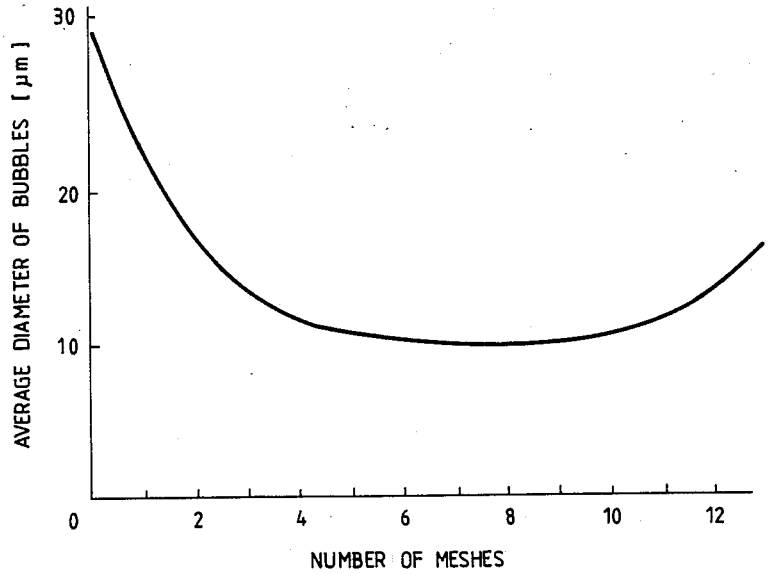
FIG. 18 shows a graph indicating the relationship between the average diameter of bubbles and the number of the meshes.

FIG. 18 shows the relationship between the average diameter of the minute bubbles and the number of the meshes 24 in the case that the number of the mesh filaments per inch is 100 and the diameter of each mesh filament is 0.1 mm.

The number of the filaments of each mesh 24 per inch also has a defined relationship with the average diameter of the minute bubbles. As a result of experiments with filament numbers of 30, 40, 50 and 100 per inch, it was found that when the number of the meshes 24 was six, the average diameter of the minute bubbles decreased as the filament number increased. The likelihood of formation of relatively large bubbles tends to decrease as the filament number increases.

Figure 15:
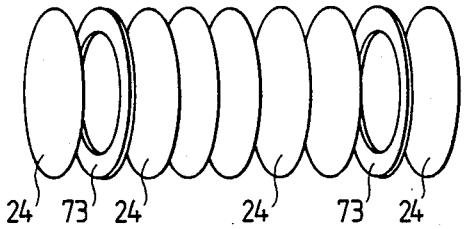
FIG. 15 shows an exploded view of a mesh assembly of the minute bubble nozzle unit shown in FIG. 13.
Figure 16:
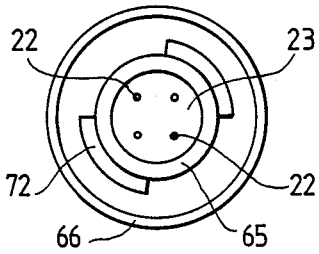
FIG. 16 shows a partial rear view of the minute bubble generating portion of the minute bubble nozzle unit shown in FIG. 13.

The meshes 24 may be juxtaposed either in contact with each other or with a gap of about 1 mm therebetween. In the latter case, a spacer 73 is interposed between the meshes 24 to maintain the gap therebetween, as shown in FIG. 15. The average diameter of the minute bubbles can be determined for a desired purpose or use by determining in advance the filament number of each mesh 24, per inch, the filament diameter thereof, the gap between the nets, and the number thereof. In other words, the filament number of each mesh 24, per inch and the filament diameter thereof are not confined to 100 and 0.1 mm, respectively, in the present invention.

Figure 17:
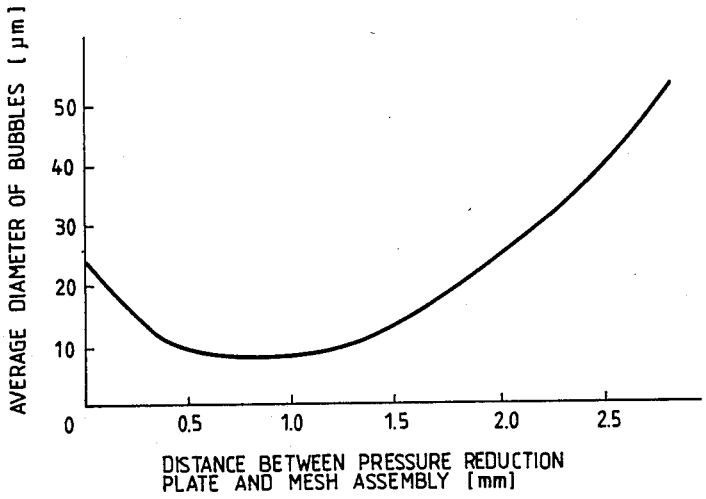
FIG. 17 is a graph indicating the relationship between the average diameter of bubbles and the distance between a pressure reduction plate and meshes.

The distance between the pressure reduction plate 23 and the mesh assembly 70 also has a defined relationship with the average diameter of the minute bubbles. FIG. 17 shows the relationship between the distance and the average diameter. It is understood from FIG. 17 that the optimal distance between the plate 23 and the mesh assembly 70 is 0.5 to 1.0 mm to minimize the average diameter of the minute bubbles.

Figure 19:
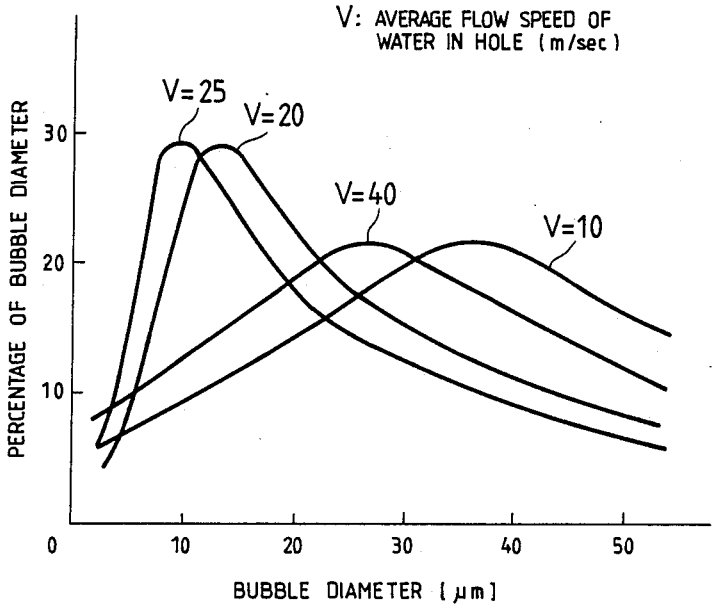
FIG. 19 shows a graph indicating the distributions of the diameters of bubbles at different average flow speeds of bath water passed through each hole of the pressure reduction plate.

As a result of experiments in which bubbles were produced as the diameter of each hole 22 of the pressure reduction plate 23, and the number of the holes, etc., were changed, it was found that the average flow speed of the bath water in each hole was 20 to 25 m/sec. for a hole diameter of 0.7 to 1.0 mm. FIG. 19 shows the distribution of the diameters of the minute bubbles. It is understood from FIG. 19 that the diameters of the minute bubbles are made smaller due to the reduction in the pressure of the pressurized bath water when the average flow speed of the water in each hole 22 is 20 and 25 m/sec. It is also understood from FIG. 19 that the diameters of the minute bubbles are made larger due to a too slow reduction in the pressure of the pressurized bath water. That is, the production of more minute bubbles in the bathtub is diminished when the average flow speed of the water in each hole 22 is 10 m/sec. It is further understood from FIG. 19 that the diameters of the minute bubbles are made much larger due to the congregating of bubbles when the pressure of the pressurized bath water is too quickly reduced when the average flow speed of the water in each hole 22 is 40 m/sec.. Thus, the number of the holes 22 of the pressure reduction plate 23 can be increased depending on the overall flow rate of the bath water as long as the diameter of each of the holes is 0.7 to 1.0 mm and the average flow speed of the water in each of the holes is 20 to 25 m/sec. However, the distance between mutually neighboring holes 22 should be about 5 mm.

Figure 20A:
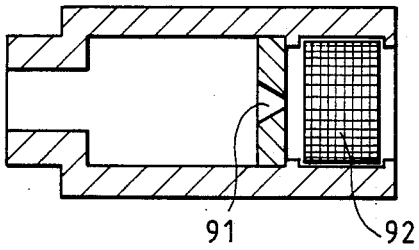
FIG. 20A shows a sectional view of a comparison minute bubble nozzle unit.
Figure 20B:
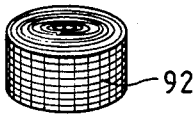
FIG. 20B shows a perspective view of the mesh of the comparison minute bubble nozzle unit.

FIG. 20 shows a comparison minute bubble nozzle unit to be compared with the minute bubble nozzle unit shown in FIG. 13. In the comparison minute bubble nozzle unit, a wound wire mesh 92 is provided in front of an orifice 91 set at 20 to 25 m/sec., the diameters of the produced air bubbles were 35 to 45 μm. When an experiment with the minute bubble nozzle unit shown in FIG. 13 including the pressure reduction plate 23 made of stainless steel and having a thickness of 1 mm and the plurality of holes 22 having a diameter of 0.7 to 1.0 mm and a spacing of 5 mm therebetween was conducted without the mesh assembly 70 with an average flow speed of the bath water in each of the holes of 20 to 25 m/sec., the diameters of the produced air bubbles were 20 to 30 μm, which is about 60% less than those produced using the comparison minute bubble nozzle unit. When an experiment with the minute bubble nozzle unit shown in FIG. 13 and including the pressure reduction plate 23 and the mesh assembly 70 made of four to ten meshes 24 of about 100 in mesh filament number per inch and about 0.1 mm in filament diameter was conduced with an average flow speed of the bath water in each of the holes 22 of 20 to 25 m/sec., a larger number of minute air bubbles of 5 to 8 μm diameter were produced.

Since the bath water 4 with air dissolved therein is introduced into the bathtub 1 through the plural holes 22 of the pressure reduction plate 23 to reduce the pressure of the water, the water is more dispersed than in the case of a minute bubble nozzle unit in which the bath water passes through only one hole. The energy or flow rate of the bath water in each of the holes 22 of the plate 23 is thus decreased so that the pressure of the water is slowly reduced. Since the bath water 4 is dispersed by the plural holes 22 of the plate 23, the bubbles are less likely to congregate to form larger bubbles. A larger number of minute bubbles is thus produced. Since the plurality of meshes 24 are juxtaposed downstream to the pressure reduction plate 23, the bath water 4 collides against the meshes immediately after being dispersed through the plural holes 22 of the plate so that the pressure of the water is slowly reduced and bubble nuclei are formed to promote the production of minute bubbles.

Figure 21:
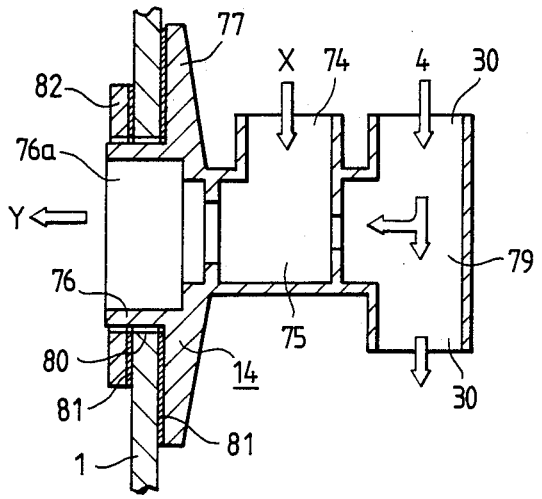
FIG. 21 shows a sectional view of a jet nozzle unit constructed according to the present invention.
Figure 22:
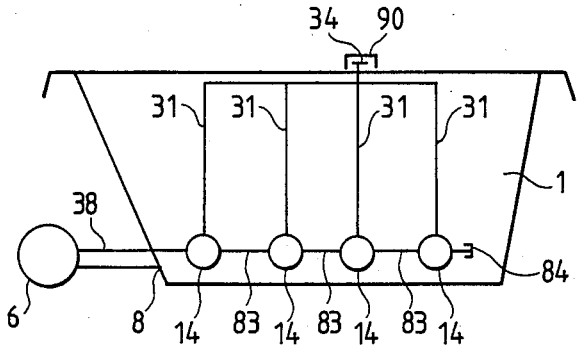
FIG. 22 shows a schematic view of an example of piping for the plurality of jet nozzle units shown in FIG. 21.
Figure 23:
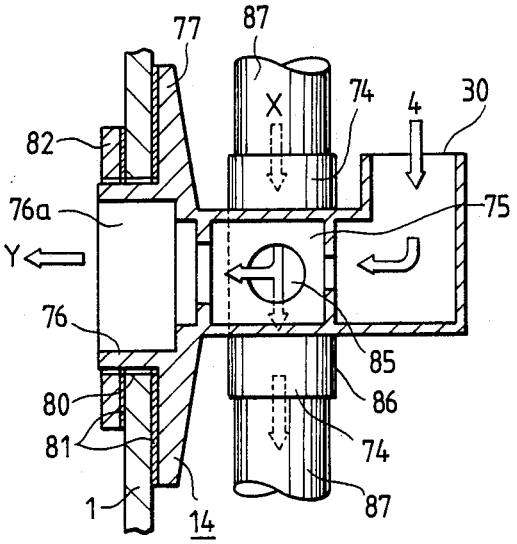
FIG. 23 shows a sectional view of a jet nozzle unit of another embodiment of the present invention.
Figure 24:
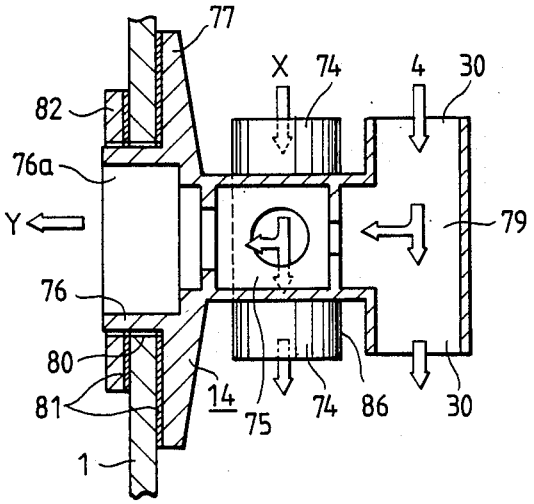
FIG. 24 shows a sectional view of a jet nozzle unit of yet another embodiment of the present invention.

FIG. 21 shows a horizontal sectional view of a jet nozzle unit 14 constructed according to an embodiment of the present invention. In the jet nozzle unit 14, the rear end of a cylinder 76 having a male screw on the outside circumferential surface of the cylinder is connected to the front of an air and water mixing chamber 75 provided with an air feed port 74 to which the end of an air pipe 31 is connected. A flange 77 is provided at the rear end of the cylinder 76. Two bath water feed ports 30 are provided at the rear of the air and water mixing chamber 75. A straight pipe 79 is provided at the rear of the air and water mixing chamber 75. The bath water feed ports 30 are located at both ends of the straight pipe. A plurality of such jet nozzle units 14 are attached to the side wall of a bathtub 1. For the attachment, the cylinder 76 is inserted into seals 81 and the attaching hole 80 of the side wall of the bathtub 1 from the outside thereof, and a nut 82 is engaged on the front part of the cylinder. As shown in FIG. 22, the bath water feed ports 30 of the mutually neighboring jet nozzle units 14 are connected to each other through straight pipes 83, each of which has its shortest length between the bath water feed ports and constitutes a part of a passage 38 of a bubble generator 2. A plug 84 is fitted in one of the water feed ports 30 of the jet nozzle unit 14 located at one end of the bubble generator 2. Because of such piping, a ramified pipe need not be provided although the plurality of jet nozzle units 14 are provided. Air pipes 31 are connected to the air feed ports 74 of the jet nozzle units 14 and connected at the upstream ends of the air pipes to an air inlet port 34. When the pump 6 is activated, bath water flows from a water inlet port 8 to the straight pipe 79 of the first jet nozzle unit 14 through the pipe 38 so that some of the water flows to the air and water mixing chamber 75 of the jet nozzle unit and the remainder of the water flows to the straight pipe 79 of the neighboring jet nozzle unit 14 through the pipe 83. The bath water 4 is fed to the air and water mixing chambers 75 of all the jet nozzle units 14 under pressure. When the bath water 4 fed to the air and water mixing chamber 75 of each jet nozzle unit 14 is spouted into the bathtub 1 through the outlet port 76*a* of the downstream end of the cylinder 76, air is sucked into the air and water mixing chamber 75 through the air feed port 74 and mixed with the bath water so that the air forms bubbles in the bath water. In FIGS. 21, 23, and 24, X denotes the air and Y denotes the bath water 4 mixed with air. Although the air feed port 74 of each jet nozzle unit 14 is open sideward as shown in FIG. 22. Although each jet nozzle unit 14 has two bath water feed ports 30 as shown in FIG. 21, the nozzle unit may have three or more bath water feed ports instead. Although the jet nozzle units 14 are connected to each other through the straight pipes 83 as shown in FIG. 21, if the nozzle units are attached to the same side wall of the bathtub 1, the jet nozzle units may be connected to each other through L-bent or U-bent pipes along the corners of the bathtub if the jet nozzle units are attached to different side walls of the bathtub.

FIG. 23 shows a horizontal sectional view of a jet nozzle unit 14 of another embodiment of the present invention. The jet nozzle unit 14 has two air feed ports 74. An air feed cylinder 85 is connected at one end thereof to an air and water mixing chamber 75 and connected at the other end of the cylinder to a pipe 86 having air feed ports 74 at both the ends thereof. The air feed ports 74 of the neighboring jet nozzle units 14 are connected to each other through an air pipe 87 which constitutes a part of an air passage 31. As a result, a ramified air pipe for connecting the air passage 31 to the jet nozzle unit 14 need not be provided so that the length of air piping is shortened.

FIG. 24 shows a horizontal sectional view of a jet nozzle unit 14 of yet another embodiment of the present invention. The jet nozzle units 14 are provided with two water feed ports 30 and two air feed ports 74 so that the length of bath water piping and that of air piping are shortened.

Figure 25:
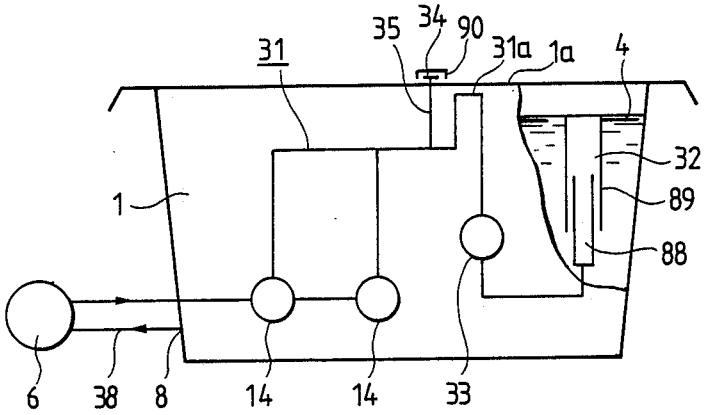
FIG. 25 shows a schematic view of an air passage in another embodiment of the present invention.
Figure 26:
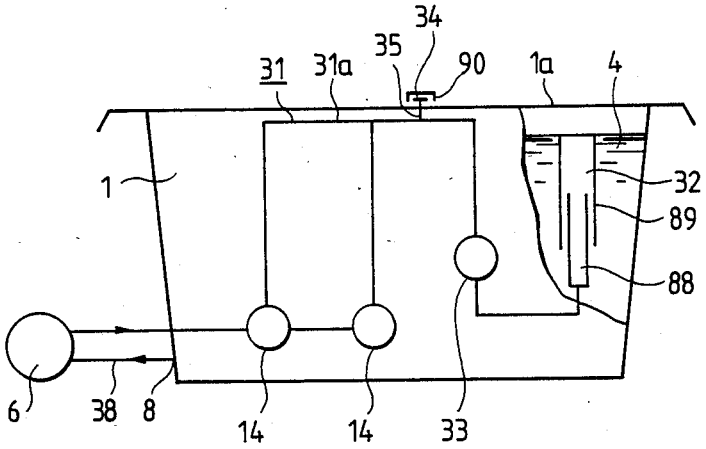
FIG. 26 shows a schematic view of an air passage in still another embodiment of the present invention.

FIGS. 25 and 26 show air passages 31 constructed according to embodiments of the present invention and which serve to feed air to jet nozzle units 14. One end of each of the air passages 31 coupled at the other end thereof to the jet nozzle units 14 is connected to a dirt remover 32 which removes dirt or the like on the surface of the bath water in the bathtub 1 when negative pressure is present in the air passage. The dirt remover 32, which is disposed in the bathtub 1, includes a fixed cylinder 88 and a movable cylinder 89 fitted on the upper portion of the fixed cylinder and movable up and down. The movable cylinder 89 is made of a material of smaller specific gravity than water, or is provided with a float (not shown in the drawings), so that the movable cylinder floats in the bath water and the open upper end of the movable cylinder is located nearly at the same height as the surface of the water. A filter 33 for accumulating the removed dirt and a ramified air pipe 35 connected at the upper end thereof to an air inlet port 34, which can be opened for air suction or closed, are provided in the air passage 31 between the dirt remover 32 and the jet nozzle units 14. The air inlet port 34 is located over the top 1*a* of the bathtub 1, and can be opened or closed by manipulating an operating portion 90 such as a knob. A portion of the air passage 31, which extends between the dirt remover 32 and the ramified air pipe 35 connected to the air inlet port 34, is located nearly at the same height as the top of the bathtub 1 so that the portion serves a header 31*a*, as. As shown in FIG. 25, the header 31*a* is located between the filter and the air inlet port 34, while alternatively, as shown in FIG. 26, the header 31*a* is disposed between two jet nozzle units 14. When the pump 6 is activated, the bath water is sent to the jet nozzle units 14 through a water inlet port 8 and a pipe 38 under pressure so that the water is spouted into the bathtub 1. If the air inlet port 34 is open, air is sucked into the jet nozzle units 14 through the air inlet port 34 so that the air is mixed into the bath water being spouted into the bathtub 1 to produce bubbles in the water in the bathtub. If the air inlet port 34 is closed, negative pressure is caused in the air passage 31 so that air or the like on the surface of the bath water in the bathtub 1 is removed by the dirt remover 32 and accumulated by the filter 33, and the bath water sucked into the air passage 31 together with the dirt is introduced into the jet nozzle units 14 and spouted therefrom into the bathtub 1. The dirt or the like from the surface of the bath water in the bathtub 1 is thus separated from the water.

If the portion of the air passage 31 which extends between the dirt remover 32 and the ramified air pipe 35 were located only slightly higher than the surface of the water in the bathtub 1, when the pump 6 is activated and the air intake port 34 is open, the bath water would be sucked into the jet nozzle units 14 from the dirt remover 32 due to the negative pressure, but the air could not be sucked into the jet nozzle units because the force for sucking the bath water from the dirt remover would be stronger than that for sucking the air into the air passage through the air inlet port. However, since the portion of the air passage 31, which extends between the dirt remover 32 and the ramified air pipe 35, is located nearly at the same height as the top of the bathtub 1 in reality, the portion of the air passage is always sufficiently higher than the surface of the water in the bathtub, even if the surface of the water rises. For that reason, when the air inlet port 34 is totally opened when the pump 6 is activated to suck the bath water from the bathtub 1 into the air passage 31 through the dirt remover 32 during the closure of the air inlet port, the bath water is not sucked into the portion of the air passage from the bathtub through the dirt remover, so that the air is surely sucked into the portion of the air passage through the air intake port.

What is claimed is:

1. A bubbling bathtub system comprising: a bathtub; large bubble generating means for blowing relatively large bubbles into said bathtub; and minute bubble generating means for dissolving air in bath water by pressurization and introducing said bath water with air dissolved therein into said bathtub to produce minute bubbles therein, said minute bubble generating means comprising a pump, an inlet pipe connecting an outlet of said bathtub to an inlet of said pump, an air suction device connection to said inlet pipe between said outlet of said bathtub and said inlet of said pump, air-water, separating means connected between an outlet of said pump and an inlet of said bathtub for discharging excess air undissolved in the bath water introduced into said bathtub by said minute bubble generating means, the amount of air dissolved in said bath water by pressurization by said pump being sufficiently great that when said bath water from said minute bubble generating means is introduced into said bathtub and is therein immediately depressurized, air dissolved therein is educed to form minute bubbles in the bath water in said bathtub.

2. The bubbling bathtub system according to claim 1, further comprising a single pump, said large bubble generating means and said minute bubble generating means jointly selectively using said single pump as a driver.

3. The bubbling bathtub system according to claim 1, wherein said large bubble generator comprises a jet nozzle unit; and further comprising: a minute bubble nozzle unit for blowing minute bubbles into said bathtub received from said outlet pipe; a changeover valve; a ramified passage connected to said inlet pipe through said changeover valve between said air-water separating means and said unit and connected to said jet nozzle unit of said large bubble generator; and a shut-off valve for opening and closing an air inlet port of said air suction device arranged so that said port is closed by said shut-off valve in conjunction with switching of said changeover valve toward said jet nozzle unit.

4. The bubbling bathtub system according to claim 1, wherein said air-water separating means comprises: a pipe provided with a large-diameter portion downwardly inclined downstream; and a riser connected to said large-diameter portion near a downstream end thereof, said riser being provided with an air release portion at a top of said riser.

5. The bubbling bathtub system according to claim 1, further comprising a vertical pipe connected to a top of an air accumulating portion of said air-water separating means; a needle fitted in said pipe so that said needle is movable up and down and a prescribed clearance for discharging gas from said air-water separating means is defined between said needle and said pipe; an upper plate is provided on a top of said needle arranged so that said plate can be moved into contact with an edge of said pipe at an open upper end thereof; and a spring, said needle being urged downward by a force of said spring.

6. The bubbling bathtub system according to claim 1, where said minute bubble generating means comprises a nozzle unit comprising a pressure reduction plate having a plurality of through-holes and located at a downstream end of said nozzle units, bath water with air dissolved therein being introduced into said bathtub through said nozzle unit, said plate acting so that the pressure of said water is reduced as said water is sent into said bathtub through said nozzle unit.

7. The bubbling bathtub system according to claim 6, wherein said nozzle unit further comprises a plurality of meshes juxtaposed together and positioned downstream of said pressure reduction plate.

8. The bubbling bath system according to claim 7, further comprising a peripheral frame for holding said plurality of meshes as an assembly.

9. The bubbling bathtub system according to claim 7, wherein said minute bubble nozzle unit comprises: a bath water intake portion which extends through a side wall of said bathtub and secured with seals to said side wall so as to keep bath water from leaking and which is provided with an opening through which pressurized bath water is introduced into said intake portion; a minute bubble outlet fixture removably attached to said intake portion from the interior of said bathtub; and a mesh holder, said reduction plate and said meshes being removably attached to said minute bubble outlet fixture with said plate being disposed in said mesh holder, said meshes being retained by said holder, and a prescribed distance being maintained between said plate and said nets.

10. The bubbling bathtub system according to claim 1, wherein said large bubble generating means comprises a jet nozzle provided with a plurality of water feed ports.

11. The bubbling bathtub system according to claim 1, wherein said large bubble generating means comprises a jet nozzle unit provided with a plurality of air feed ports.

* * * * *